US005281975A

United States Patent [19]

Hugo

[11] Patent Number: 5,281,975

[45] Date of Patent: Jan. 25, 1994

[54] BASE SUPPORT FOR MOVABLE ANTENNA

[75] Inventor: Albert Hugo, County of Santa Barbara, Calif.

[73] Assignee: J.G.S. Engineering Inc., St. Louis, Mo.

[21] Appl. No.: 771,172

[22] Filed: Oct. 3, 1991

[51] Int. Cl.[5] ..... H01Q 3/00

[52] U.S. Cl. ..... 343/766; 343/882; 248/183

[58] Field of Search ..... 343/766, 763, 765, 878, 343/880, 882, 890; 248/183, 180, 519, 522;

[56] References Cited

U.S. PATENT DOCUMENTS

| | | | |
|---|---|---|---|
| 3,495,261 | 2/1970 | Lastinger et al. | 343/766 |
| 4,040,058 | 8/1977 | Mori et al. | 343/766 |
| 4,126,865 | 11/1978 | Longhurst | 343/766 |
| 4,454,515 | 6/1984 | Major et al. | 343/882 |
| 4,475,110 | 10/1984 | Hutchins | 343/769 |
| 4,617,572 | 10/1986 | Hugo | 343/765 |
| 4,841,309 | 6/1989 | Burr | 343/766 |
| 5,065,969 | 11/1991 | McLean | 343/766 |

FOREIGN PATENT DOCUMENTS

| | | |
|---|---|---|
| 58-95406 | 6/1983 | Japan . |
| 2051484 | 1/1981 | United Kingdom . |

OTHER PUBLICATIONS

The Design and Selection of Mechanical Elements: Helical, Worm and Berd Gears pp. 252-253.

*Primary Examiner*—Donald Hajec
*Assistant Examiner*—Hoanganh Le
*Attorney, Agent, or Firm*—Polster, Polster and Lucchesi

[57] ABSTRACT

A base support for supporting, positioning and securely maintaining a desired position of a communications dish antenna includes a non-rotatable worm gear having radially outwardly extending teeth and a motor driven worm having a continuous helical tooth intermeshed with adjacent ones of the worm gear teeth. In order to prevent backlash between the gears should any of the gear teeth become worn, damaged or otherwise deteriorated, the worm is pivotally mounted with respect to the worm gear and a force means such as a spring continuously urges the worm toward the worm gear to maintain tight intermeshing engagement. Thus, in the event of uneven or intermittent gear tooth deterioration, the communications dish antenna will be maintained securely in a desired position. Also, the support permits 360° movement of the antenna around the base support and the pivotal mounting of the worm alleviates jamming of the gears.

5 Claims, 5 Drawing Sheets

BASE SUPPORT FOR MOVABLE ANTENNA

BACKGROUND OF THE INVENTION

The invention relates to base supports or mounting assemblies for movable antennae, especially communications dish antennae such as dish antennae for audio, video or data signals.

It is well known that a satellite antenna may be mounted on a support having relatively movable parts which allow the antenna to be aimed toward a particular satellite in geostationary orbit above the earth to collect signals relayed and/or transmitted from that satellite. A description of the general operation of dish antennae and the relationship thereof to orbiting satellites beaming signals to such antennae is contained in my U.S. Pat. No. 4,617,572, issued Oct. 14, 1986, the disclosure of which is incorporated herein by reference thereto.

As is described in U.S. Pat. No. 4,617,572 it is known to provide a base support for a dish antenna having vertical adjusting means to adjust the position of the antenna along a vertical plane to direct the antenna toward the "Clark belt" or "geostationary satellite belt." Thereafter, horizontal adjustment means on the base support, including a reversible motor may be used to scan back and forth along the satellite belt until desired signals from a particular satellite are clearly being received by the dish antenna.

According to my prior patent, as most clearly shown in FIGS. 2, and 5–7 thereof, a reversible electric motor 52 drives a worm W which is in intermeshing contact with a worm gear, referred to in my prior patent as a 180° quadrant gear, 50. The motor 52 is mounted stationery in the horizontal plane, while revolution of worm W will cause worm gear 50 to move in the horizontal plane, thus repositioning the attached dish antenna. It can readily be seen that this structure permits only 180° movement of the dish antenna since worm gear 50 only extends 180° around the vertical support shaft of the antenna. Further, even if gear 50 were extended completely around the vertical support shaft, stationary motor 52 would obstruct full 360° rotation of the antenna. While 360° rotation of a home television dish antenna is not normally necessary due to the permanent installation of the dish support and the equatorial location of the satellite belt, such full rotation is desirable for mobile satellite antennae such as are used on recreational vehicles, mobile news vans or the like. Also in the past, multiple 360° revolutions of a mobile antenna would necessitate the inclusion of relatively expensive electrical interface slip rings.

It has also been found that since home satellite antennae are normally set for relatively long periods of time in only a few horizontal positions corresponding to the satellite beams available, the worm gear 50 is subject to uneven wear. More specifically, when worm W is stopped, the intermeshing of worm W with gear 50 is the only means utilized to maintain the precise positioning of the antenna. In the positions most used; that is, the positions where the helical tooth of worm W most often statically contacts a small number of the teeth of gear 50, the teeth of the gears may experience greater or uneven wear. When this occurs, backlash between the worm and the worm gear may be experienced producing loose intermeshing contact between worm W and gear 50 at some or all of the relative positions. This backlash may cause the antenna to vibrate when completely motionless stability is required for best performance.

Another problem which may be experience in my prior art mechanism is that if dirt or a rock should become lodged between adjacent teeth of gear 50, the system may become jammed when worm W comes in contact with the obstruction.

SUMMARY OF THE INVENTION

It is therefore an object of the invention to provide a base support for a movable antenna which permits the antenna to pivot in the horizontal plane at least a full 360° without obstruction, and can rotate multiple 360° turns without the necessity of expensive electrical slip rings.

It is another important object of the invention to provide an antenna support having means for ensuring a tight intermeshing fit between the teeth of two gears even though uneven wear of the gear teeth may have occurred, to thereby maintain static, non-vibrating aiming of the antenna at all positions.

It is a further object of the invention to provide an antenna support having intermeshing gear teeth which will alleviate jamming should obstructions be lodged between gear teeth.

Generally speaking, the present invention is a base support for supporting, positioning and maintaining a desired position of an antenna such as a satellite dish antenna, comprising an upstanding base member and an antenna support on the base member and movable relative thereto. A pair of intermeshing gears are mounted between the base member and the antenna support; relative movement of the gears producing relative movement between the antenna support and the base member. A reversible electric motor drives one of the gears. One of the gears is mounted so as to be movable toward and away from tight intermeshing contact with the other gear and means for exerting a force, such as a spring, continuously urges the gears into tight intermeshing contact thereby maintaining such contact to ensure the maintenance of a desired position of the antenna support relative to the base member when the gears are inactive even though uneven wear has taken place on all or only a portion of the gear teeth. Also should an obstruction between the teeth of a gear be encountered, the force of the spring may be overcome to allow the gears to temporarily move apart and maintain dynamic operation which may act to clear the obstruction.

Further, the invention includes the provision of a motor driven helical tooth worm connected for movement with the antenna support, while a 360° worm gear is fixed in a generally horizontal plane to the base support. This construction permits the motor to always travel behind the antenna dish, thereby eliminating the prior art obstruction which prohibited 360° movement of the dish antenna.

These as well as other objects and advantages of the present invention will become more apparent upon a reading of the following detailed description of the preferred embodiment in conjunction with the drawings, wherein:

DETAILED DESCRIPTION OF THE PREFERRED EMBODIMENT

Figure 1:
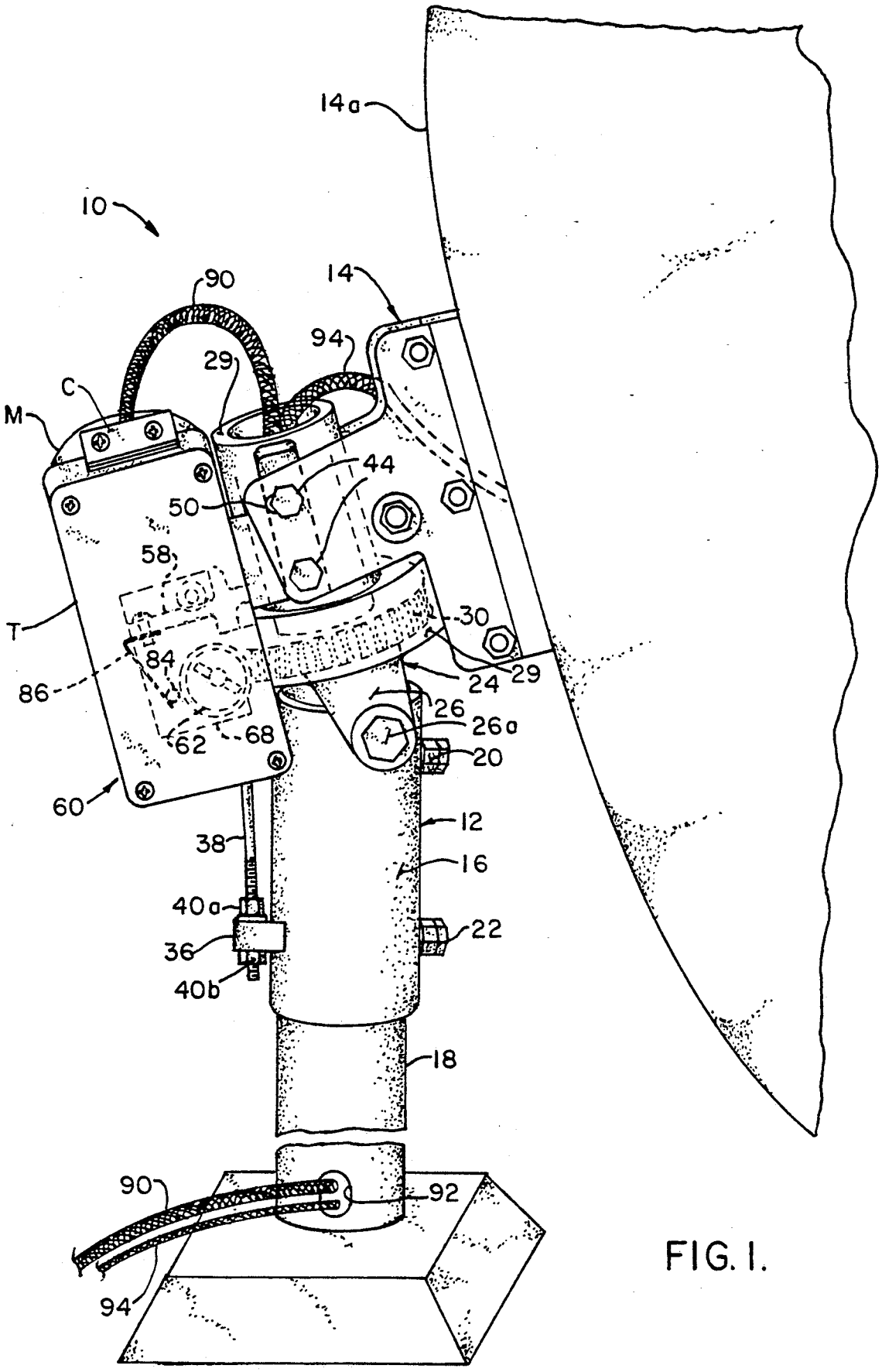
FIG. 1 is a perspective view of the preferred embodiment of a base support for a movable antenna constructed in accordance with the principles of the present invention showing the novel gear relationship, which is normally covered, in phantom line.

With reference to the drawings, and FIG. 1 in particular, there is shown a base support for a dish antenna, or the like, generally referred to by reference character 10, constructed in accordance with the principles of the the present invention. Base support 10 generally includes a base member 12 and an antenna support 14 on base member 12 adapted for carrying a dish antenna 14*a* and movable relative to base member 12. Base member 12 is comprised of a tubular steel member 16 of sufficient internal diameter to enable placement thereof over an upright post 18 which may be permanently secured in the ground or, in the case of a mobile antenna, post 18 may be secured to the top of a van or recreational vehicle (not shown). Tubular member 16 may be placed over post 18 and secured thereto by means of set bolts 20 and 22.

Adjacent the top of tubular member 16 there is attached a cast metal worm gear member 24 having diametrically opposed support legs 26, 28 (FIG. 3) which are pivotally mounted to member 16 by nut and bolt sets 26*a*, 28*a*. The upper portion of gear member 24 and other associated parts to be described hereinafter are protected from rain and dust by molded plastic cover 29.

Figure 2:
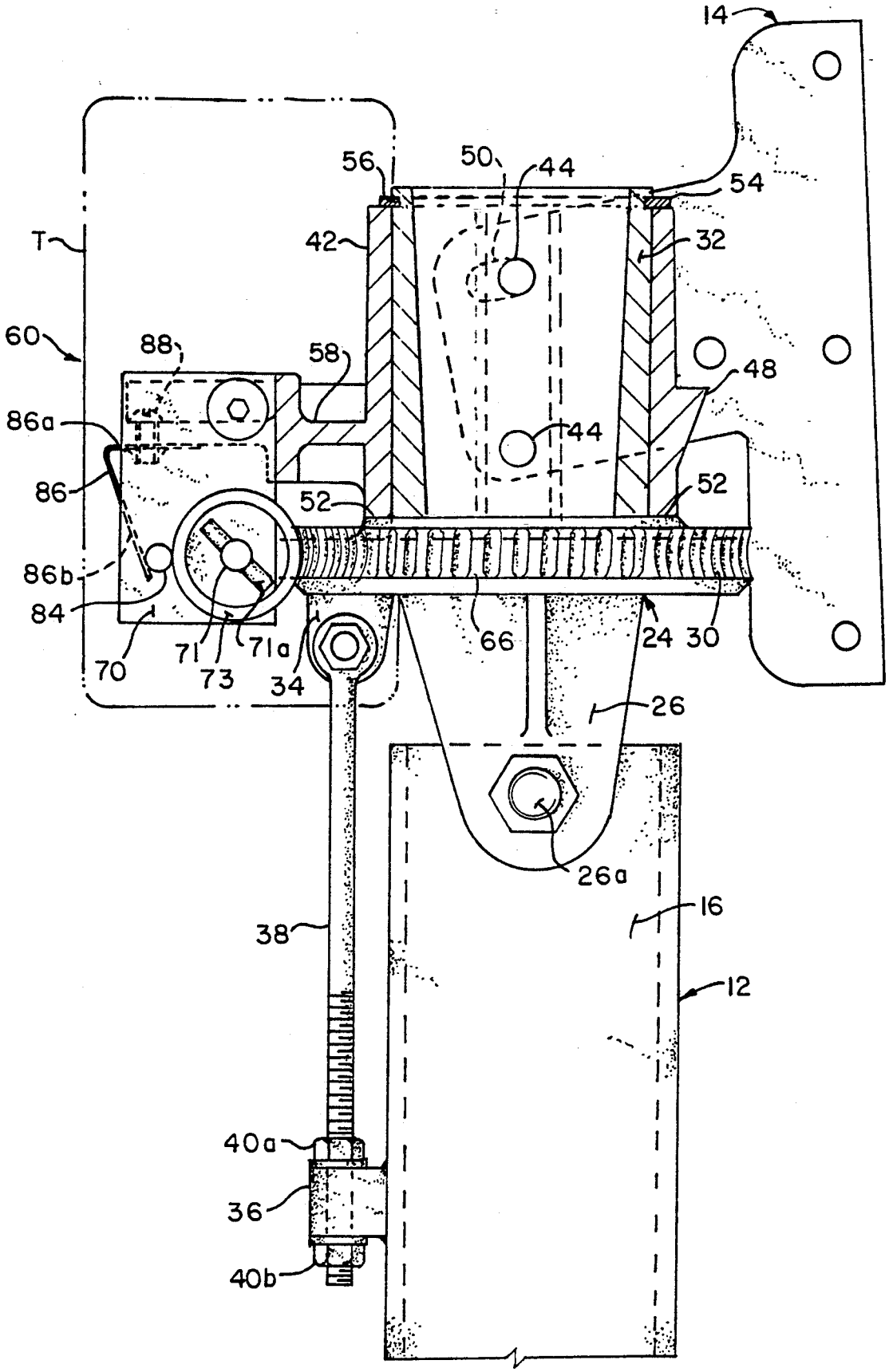
FIG. 2 is a side elevational view, partially in cross-section, of the base support with the cover member and wire leads removed.

As best seen in FIG. 2, worm gear member 24 also includes integrally formed with support legs 26, 28, a generally horizontally disposed worm gear 30, an upstanding tubular inner main bearing 32 and a downwardly directed lobe 34. Lobe 34 is located on the underside of worm gear 30 on a radial line perpendicular to the pivot axis formed by nut and bolt sets 26, 28.

Lobe 34 of worm gear member 24 is attached to a side bracket 36 on tubular member 16 by connecting rod 38. Connecting rod 38 is pivotally connected to lobe 34 and is threaded adjacent bracket 36 to allow adjustment of the effective length of rod 38 between lobe 34 and bracket 36 by means of set bolts 40*a*, 40*b*. In this manner, worm gear member 24 may be tilted and set in a position about the pivot axis formed by nut and bolt sets 26*a*, 28*a* to adjust antenna support bracket 14 in a vertical plane. It is noted that many other length adjusting means may be utilized in place of rod 38 as shown, such as a turnbuckle between lobe 34 and bracket 36. It is also noted that while rod 38 provides for the tilting of worm gear 30 out of a purely horizontal plane in order to adjust the vertical angle of antenna support 14 and an attached dish antenna 14*a*; for purposes of clarity, worm gear 30 will be described as being in a generally horizontal plane as shown in FIGS. 2–5.

Figure 3:
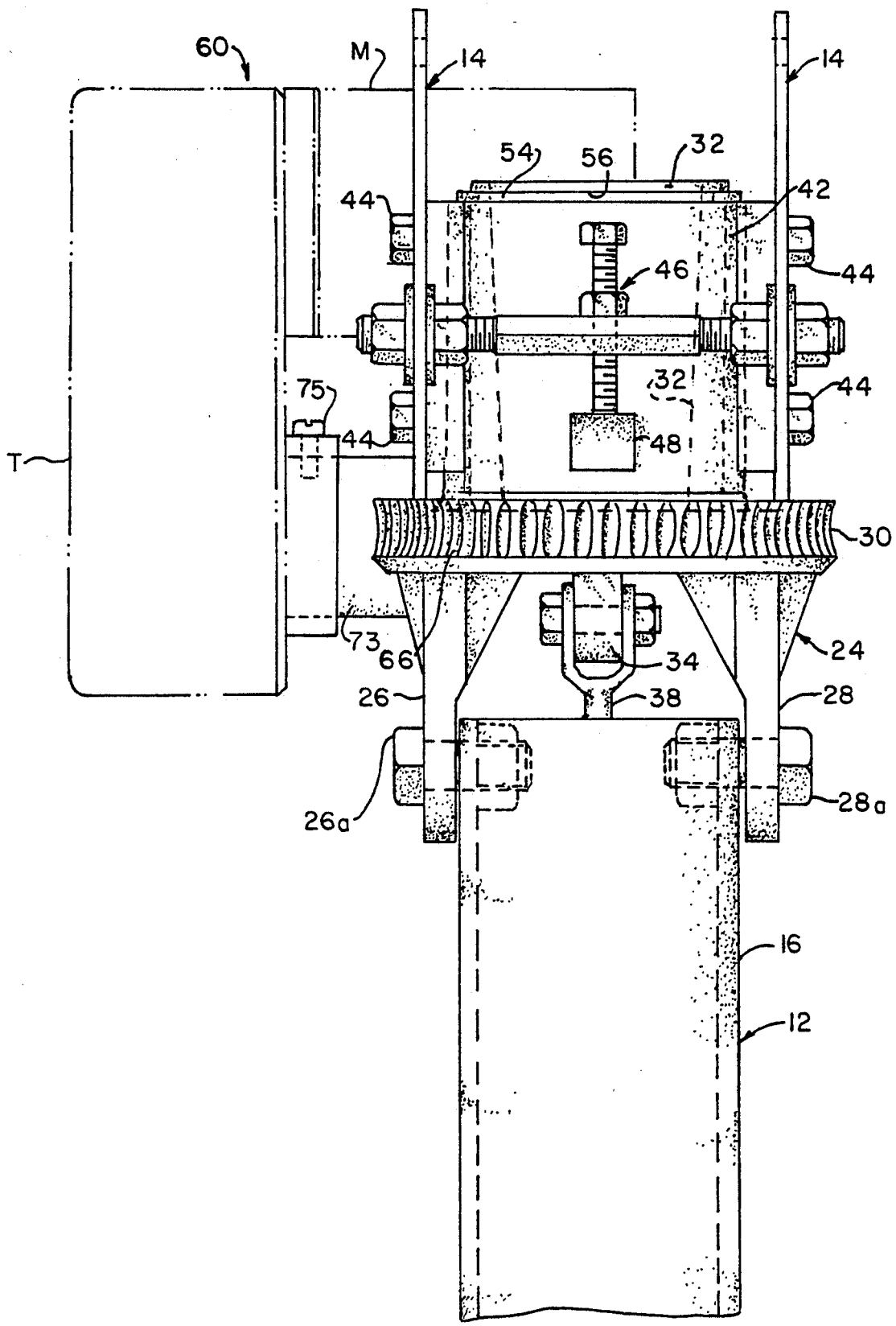
FIG. 3 is front elevational view of the base support with the cover member and wire leads removed.
Figure 4:
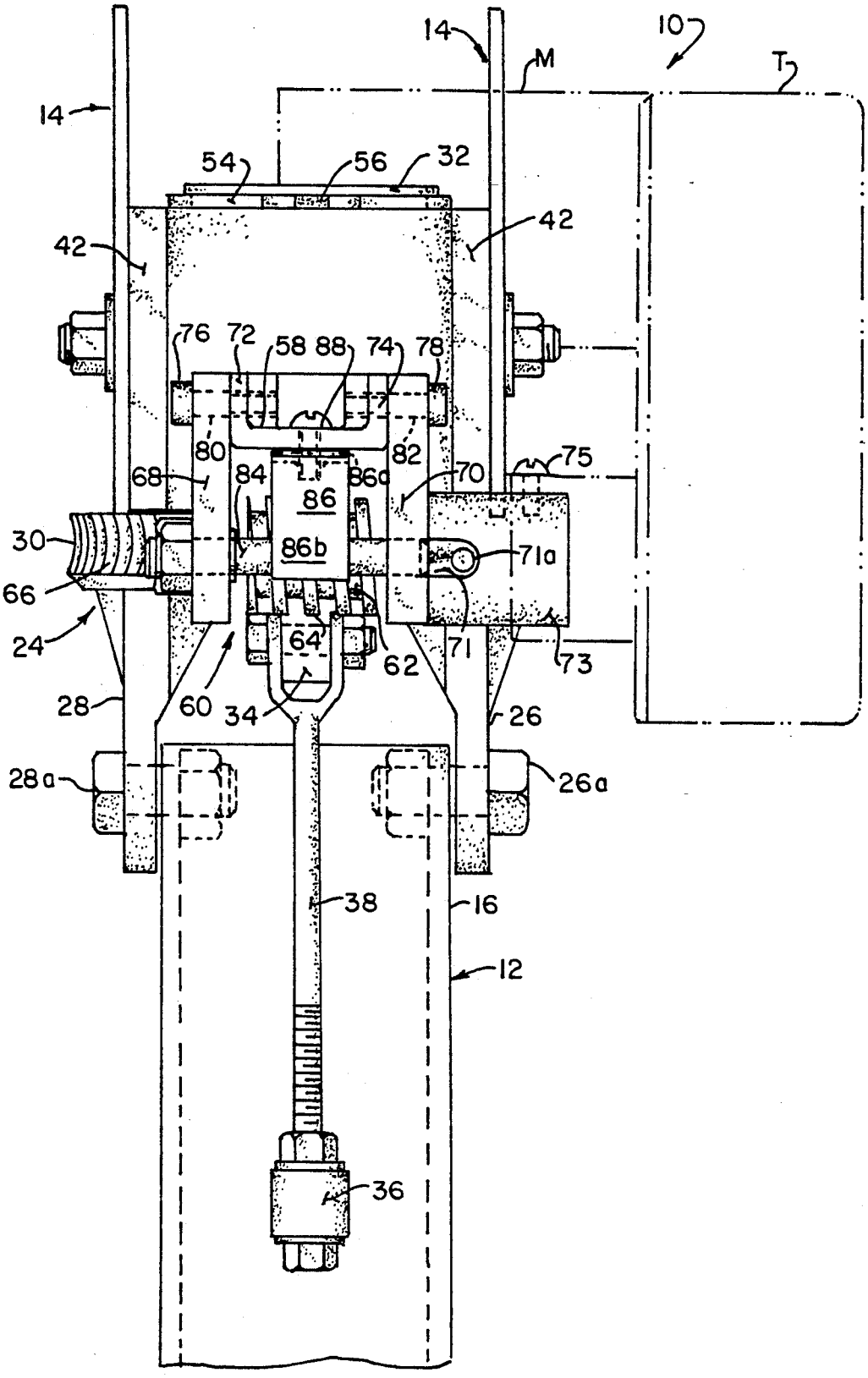
FIG. 4 is a rear elevational view of the base support with a cover member and wire leads removed and the motor and transmission represented in phantom line for clarity.

Antenna support 14 is attached to diametrically opposed sides of a tubular outer main bearing member 42 by means of bolts 44. As shown in FIG. 3, a set screw assembly 46 abuts upon a projection 48 on outer main bearing 42, and in conjunction with slots 50 (FIG. 1) in antenna support 14, acts to fine tune the vertical angle of the antenna 14*a*.

Outer tubular main bearing 42 is sized to snugly fit around inner main bearing 32 and slidingly rests upon an annular, horizontal bearing surface 52 (FIG. 2) formed on the upper surface of worm gear member 24 radially outward of inner main bearing 32. Outer main bearing 42 is held against vertical movement with respect to inner main bearing 32 by means of a split-ring retainer clip 54 locked within an annular groove 56*b* formed near the top of inner bearing member 32.

Outer main bearing 42 is formed with an integrally cast radially outwardly extending arm 58. Arm 58 is positioned on the opposite side of outer main bearing 42 from antenna 14*a* and carries motor driven worm assembly 60.

Figure 5:
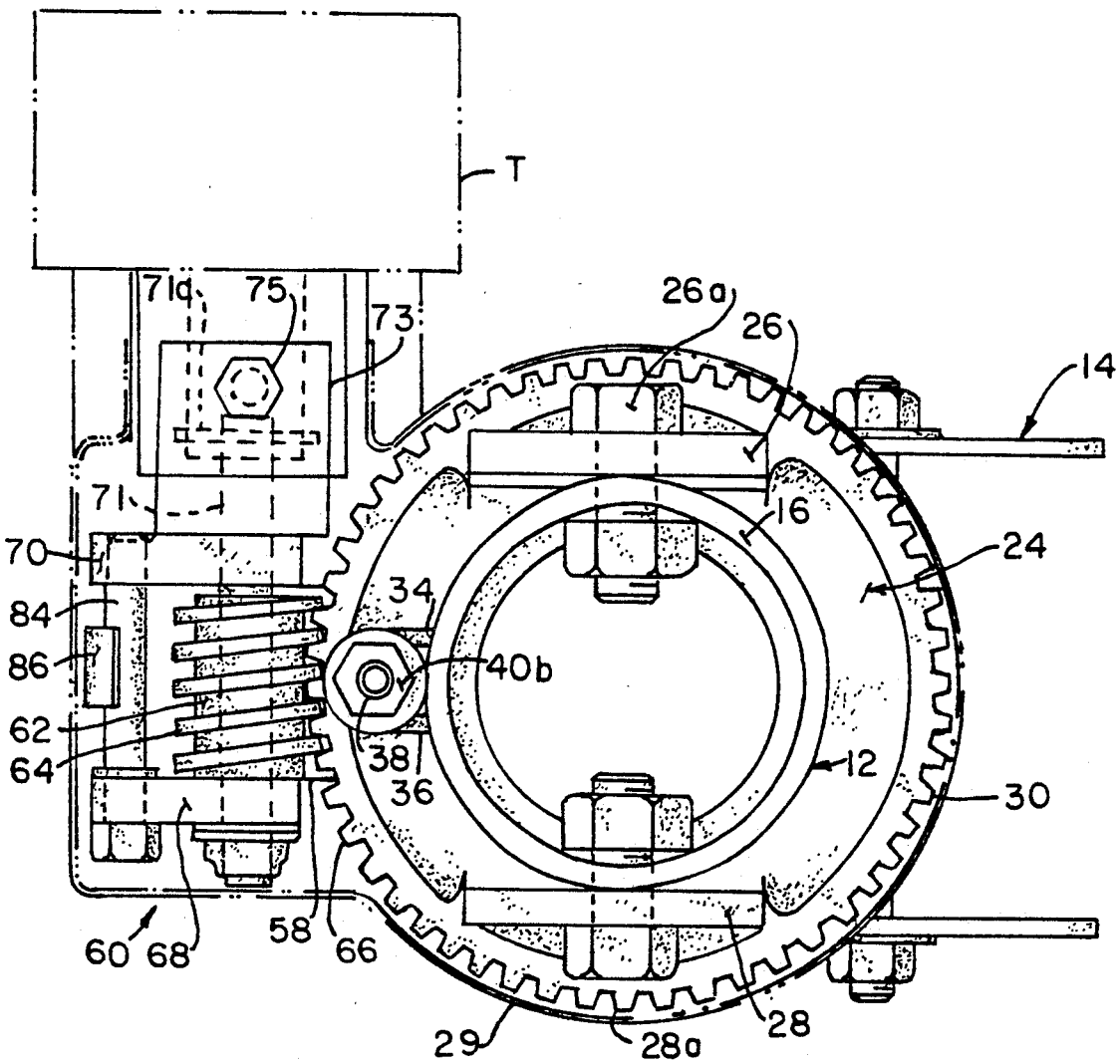
FIG. 5 is a bottom plan view of the base support with the wire leads removed.

Worm assembly 60 includes a generally cylindrical worm 62 having a continuous helical tooth 64 in tight intermeshing contact with adjacent ones of the radially outwardly directed teeth 66 which are positioned 360° circumferentially around worm gear 30 (See FIG. 5). Worm 62 is mounted for rotation about a horizontal axis in end bearing plates 68 and 70. Worm 62 may be driven in either direction of rotation by reversible electric motor M which is operationally connected to the drive shaft 71 and transverse drive pin 71*a* of worm 62 through suitable gear transmission T (not specifically shown). Motor M and transmission T are supported and carried by tubular support 73 attached to side plate 70 and are secured to support 73 by screw 75.

Bearing plates 68 and 70 are pivotally secured to upwardly directed portions 72 and 74, respectively, (FIG. 4) of arm 58 by means of screws 76 and 78, respectively, which pass through bores 80 and 82, respectively, in side bearing plates 68 and 70, respectively; and threadingly engage portions 72 and 74, respectively, of arm 58. A transverse bar 84 is secured between side plates 68 and 70 and is positioned in substantially the same horizontal plane occupied by the axis of rotation of worm 62. A flat spring or leaf spring 86 of spring steel has a horizontal leg 86*a* secured to the underside of arm 58 by means of nut and bolt assembly 88. Spring 86 also includes a downwardly extending leg 86*b* which extends from leg 86*a* to forcefully abut against bar 84. As the natural, untensioned, position of leg 86*b* of spring 86 would form a more acute angle with leg 86*a* than that formed when leg 86*b* abuts bar 84, spring 86 exerts a continuous force on bar 84, side bearing plates 68, 70 and worm 62; thus urging worm 62 toward worm gear 30 and forcing helical worm tooth 64 into tight intermeshing contact with the teeth 66 of worm gear 30. Spring 86 is able to effect movement of side plates 68, 70 due to the pivot connection between side plates 68, 70 and arm 58 on main outer bearing member 42 at pivot screws 76, 78. It is to be noted that the entire motor driven worm assembly 60 comprised of motor M, transmission T, worm 62, side bearing plates 68, 70 and transverse bar 84 all pivot together about pivot screws 76, 78 on arm 58 allowing worm 62 to freely move toward or away from worm gear 30 as worm 62 is being driven subject to the force exerted upon worm assembly 60 by spring 86.

Motor M is placed in electric communication with a conventional remote control unit (not shown), and is powered through wire leads 90 (FIG. 1) which are located from connector terminals C, through a hole in cover 29, down through the interior of inner main bearing 32, between support legs 26 and 28, through the interior of tubular steel member 16 and post 18 and out of post 18 through lead access passage 92. Antenna lead 94 follows the same path as lead 90 except it is operationally connected to antenna 14*a* instead of motor M in a well known manner.

In operation, after antenna support 14 is secured in a proper vertical position by adjustment rod 38 and fine adjustment set screw assembly 46, base support 10 is ready to scan in a generally horizontal plane around the axis of worm gear 30. Conventional remote motor controls (not shown) are activated to operate electric motor M through wire leads 90 in either direction of rotation. Motor M drives gear transmission T which is operationally attached to drive shaft 71 of worm 62 to rotate helical tooth 64 about the horizontal axis of shaft 71 in a desired rotational direction. Inasmuch as worm gear 30 is held in place by support legs 26, 28, rotation of worm tooth 64 will cause worm 62 to revolve, along with worm assembly 60 and antenna support 14, all affixed to outer main bearing member 42, around worm gear member 24. The surfaces between outer main bearing member 42 and inner main bearing member 32 and horizontal bearing surface 52 are sufficiently smooth and lubricated to provide smooth movement of outer main bearing member 42, along with the parts thereon, relative to worm gear member 24 about the substantially vertical axis of inner and outer bearing members 32 and 42, respectively. When motor M is stopped, worm 62 will not rotate, thus providing a locked positioning of antenna support 14.

Since it will be common to periodically change the horizontal positioning of antenna 14*a* to only a few locations corresponding to the location of particular satellites, worm 62 when activated will travel to only a few circumferential areas of worm gear 30 and thereafter, when inactive, will stop in locked engagement with relatively few groups of teeth 66 of worm gear 30. It has been found that the teeth of worm gear 30 may experience uneven frictional wear over a period of time. Should this condition occur, worm 62 will be urged toward worm gear 30 into tight intermeshing engagement with worm gear 30 by the continuous force of spring 86, thus ensuring the maintenance of the desired position without vibration of antenna support 14 and antenna 14*a* relative to base member 12 when worm 62 is inactive.

If the helical tooth 64 of worm 62 should encounter a rock, dirt, etc. jammed between the teeth 66 of worm gear 30 as worm 62 revolves around worm gear 30, the obstruction may overcome the force of spring 86 allowing worm 62 to pivot on the pivot axis of screws 76, 78 to move away from worm gear 30 and thus pass over the obstruction, or move likely cause the obstruction to be dislodged from between teeth 66. Thereafter, spring 86 will return worm 62 to its normal tight intermeshing contact with worm gear 30.

Since motor M and transmission T are attached to and travel with worm 62 and outer main bearing member 42, antenna 14*a* can never collide with these parts, thus antenna 14*a* is capable of rotating 360° around worm gear 30 as might be desirable with a mobile dish antenna. In fact, the assembly according to the present invention is capable of rotating multiples of 360° in either direction, and is limited only by the number of twists which will tolerably occur in leads 90 and 94. In the preferred embodiment, it is contemplated that the leads 90 and 94 can tolerate rotation of antenna 14*a* approximately 1000 degrees in either direction. In this case, the motor can be controlled by adjustable limit switches to prevent rotation more than 1000 degrees in either direction. Thus it can be seen that an economical assembly is provided which allows multiple revolutions of antenna 14*a* in either direction of rotation without the necessity of expensive electrical slip ring interfaces.

It can thus be seen that the preferred embodiment of the present invention described hereinabove fulfills the objects and attains the advantages set forth above. Inasmuch as numerous changes or modifications may be made to the preferred embodiment, e.g., a helical or other type spring, a hydraulic piston assembly or a solenoid assembly may be used in place of leaf spring 86 to provide a continuous force on worm 62; without departing from the spirit and scope of the invention, the scope of the invention is to be determined solely by the language of the following claims.

What is claimed is:

1. A base support for supporting, positioning and maintaining a desired position of an antenna comprising:
   - a base member, said base member including a tubular member having a top end and a bottom end;
   - a stationary worm gear member having a worm gear and diametrically opposed support legs formed with it for mounting said worm gear member to said tubular member, said worm gear member being pivotally mounted to said tubular member along said support legs, said worm gear member having an upstanding tubular inner main bearing and a downwardly directed lobe attached to it;
   - means for adjusting the position of said worm gear member to preselectively position said worm gear member with respect to a vertical axis associated with said lobe;
   - an outer main bearing member interconnected with said inner main bearing and movable with respect thereto, said outer main bearing member having a first end and a second end, one of said first and second ends resting on said worm gear member;
   - means for preventing movement of the outer main bearing member against vertical movement with respect to the inner main bearing;
   - antenna support means attached to said outer main bearing member;
   - a worm assembly mounted on said outer main bearing member, said worm assembly including a worm operatively connected to said worm gear, said worm assembly including a motor for driving said worm, said worm being mounted such that it is movable toward tight intermeshing contact with said worm gear; and means for exerting a continuous force on said worm urging said worm toward tight intermeshing contact with said worm gear, thereby maintaining tight intermeshing contact between said worm gear and said worm and ensuring the maintenance of the desired position of said antenna support means relative to said base member, said motor, said worm assembly, said antenna support means and said antenna all being movable upon operation of said motor.

2. The base support of claim 1 wherein said worm is mounted such that it is movable away from tight intermeshing contact with said worm gear in the event an obstruction between certain of the teeth of said worm gear should be encountered by said worm.

3. The base support of claim 2 wherein the means for exerting a continuous force is a leaf spring.

4. The base support of claim 3 wherein said spring has one end fixed to said inner main bearing and has an opposite end thereof urging said outer main bearing member towards said worm gear.

5. The base support of claim 4 wherein said worm gear has teeth positioned at least partially circumferentially thereabout.

* * * * *